US009915249B2

(12) United States Patent
Suzuki et al.

(10) Patent No.: US 9,915,249 B2
(45) Date of Patent: Mar. 13, 2018

(54) HYDRAULIC ROTATING EQUIPMENT, AND WORKING MACHINE PROVIDED WITH THIS HYDRAULIC ROTATING EQUIPMENT

(71) Applicant: Hitachi Construction Machinery Co., Ltd., Tokyo (JP)

(72) Inventors: Kenta Suzuki, Tokyo (JP); Motoshi Suzuki, Tsuchiura (JP); Shigeyuki Sakurai, Tsuchiura (JP); Makoto Hemmi, Tokyo (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 612 days.

(21) Appl. No.: 14/571,784

(22) Filed: Dec. 16, 2014

(65) Prior Publication Data

US 2015/0167650 A1 Jun. 18, 2015

(30) Foreign Application Priority Data

Dec. 16, 2013 (JP) ..... 2013-259315

(51) Int. Cl.
*F04B 1/20* (2006.01)
*F04B 1/30* (2006.01)

(52) U.S. Cl.
CPC ..... *F04B 1/2035* (2013.01); *F04B 1/2042* (2013.01); *F04B 1/303* (2013.01)

(58) Field of Classification Search
CPC ..... F04B 1/2035; F04B 1/2042; F04B 1/122; F04B 1/303
USPC ..... 417/269, 271; 91/6.5, 472–507; 92/54–58
See application file for complete search history.

(56) References Cited

U.S. PATENT DOCUMENTS 1,867,308 A * 7/1932 Durner ..... F16H 39/14 91/487
3,779,137 A * 12/1973 Koivunen ..... F04B 1/20 91/489

(Continued)

FOREIGN PATENT DOCUMENTS

JP 51-14282 B 2/1976

OTHER PUBLICATIONS

Author: Jong et al. Title: Bearing Pad Effects Date Published (yyyy): 2003 . Date Accessed (mm/dd/yyyy): Dec. 22, 2017 Link: https://link.springer.com/content/pdf/10.1007/BF02984396.pdf.*

*Primary Examiner* — Chirag Jariwala
(74) *Attorney, Agent, or Firm* — Baker Botts L.L.P.

(57) ABSTRACT

Disclosed is hydraulic rotating equipment provided with a rotating shaft, a cylinder block including a plurality of cylinders, a like plurality of pistons accommodated in the cylinders, respectively, and a valve plate maintained in slide contact with a rear end surface of the cylinder block. The valve plate includes a low-pressure port communicable with the cylinders, a high-pressure port formed in an arcuate shape over a predetermined angle along a circumferential direction of the rotating shaft and communicable with the cylinders, a seal land maintained in slide contact with the rear end surface, and a sliding contact member arranged on a periphery of the seal land in a range of the predetermined angle along the circumferential direction of the rotating shaft and maintained in slide contact with the rear end surface. A working machine provided with the hydraulic rotating equipment is also disclosed.

10 Claims, 15 Drawing Sheets

(56) References Cited

U.S. PATENT DOCUMENTS

| | | | | | |
|---|---|---|---|---|---|
| 5,253,983 | A * | 10/1993 | Suzuki | ..... | F04B 1/2021 417/485 |
| 2003/0126982 | A1 * | 7/2003 | Brooks | ..... | F04B 1/2021 91/499 |

* cited by examiner

HYDRAULIC ROTATING EQUIPMENT, AND WORKING MACHINE PROVIDED WITH THIS HYDRAULIC ROTATING EQUIPMENT

CROSS-REFERENCE TO RELATED APPLICATION

This application claims the priority of Japanese Patent Application 2013-259315 filed Dec. 16, 2013, which is incorporated herein by reference.

BACKGROUND OF THE INVENTION

1. Field of the Invention

This invention relates to hydraulic rotating equipment suited for use as a hydraulic pump, hydraulic motor or the like, and also to a working machine provided with the hydraulic rotating equipment.

2. Description of the Related Art

In general, hydraulic rotating equipment which are widely used as hydraulic pumps, hydraulic motors and the like are each provided, for example, with a cylindrical casing forming an outer shell, a rotating shaft connected to an output shaft of a prime mover and rotatably arranged in the casing, a cylinder block defining therein a plurality of cylinders formed at intervals in a circumferential direction of the rotating shaft, and a like plurality of pistons accommodated in the plurality of cylinders, respectively, of the cylinder block and reciprocable in association with rotation of the cylinder block.

Such hydraulic rotating equipment is also provided with shoes, a swash plate, and a valve plate. The shoes are held slidably with end portions of these plural pistons, are rotatable together with the cylinder block, and are in slide contact with the swash plate. The valve plate is in slide contact with an end surface (rear end surface) of the cylinder block, said end surface being on a side opposite to the swash plate, and defines therethrough a low-pressure port and a high-pressure port intermittently communicable with the cylinder block under rotation. On a surface of the valve plate, said surface being maintained in slide contact with the cylinder block, there is formed a seal land that seals hydraulic oil from the low-pressure port or high-pressure port. By this seal land, it is possible to suppress the leakage of hydraulic oil from the low-pressure port or high-pressure port.

When the hydraulic rotating equipment configured as described above is used as a hydraulic pump, upon rotation of the rotating shaft by an output from the prime mover, the cylinder block rotates together with the rotating shaft so that each piston reciprocates. At this time, the hydraulic oil flows into each cylinder of the cylinder block from the low-pressure port of the valve plate, and by the corresponding piston, is pressurized and delivered from the high-pressure port of the valve plate.

When the hydraulic rotating equipment is used as a hydraulic motor, on the other hand, the flowing of high-pressure hydraulic oil from the high-pressure port into each cylinder of the cylinder block allows the hydraulic oil, which has flowed in, to act on the corresponding piston. At this time, the piston is pressed against the side of the swash plate under the hydraulic pressure of the hydraulic oil. After rotating the rotating shaft together with the cylinder block, the hydraulic oil is, therefore, returned to a hydraulic oil tank from the low-pressure port.

When the hydraulic rotating equipment is used as the hydraulic pump, the cylinder block generally rotates in one direction. When the hydraulic rotating equipment is used as the hydraulic motor, on the other hand, the hydraulic rotating equipment is designed such that the cylinder block can rotate in two directions, in other words, can undergo both forward rotation and reverse rotation. By reverse rotation of the cylinder block, the high-pressure port and low-pressure port of the valve plate, therefore, change with each other.

The slide contact surface of the valve plate as a stationary element and that of the cylinder block as a rotating element are designed such that balance can be maintained between force, under which the cylinder block is pressed against the valve plate by hydraulic pressure, and static pressure, which is caused by leakage of hydraulic oil to the slide contact surfaces of the valve plate and cylinder block, in order to suppress a reduction in volumetric efficiency as a result of leakage of the high-pressure hydraulic oil. In particular, the hydraulic oil leaks in a large amount from the high-pressure port. Accordingly, the slide contact surfaces of the valve plate and cylinder block have been often designed to make smaller the clearance between the seal land of the valve plate, said seal land being on the side of the high-pressure port, and the cylinder block, and seizure has tended to occur at the seal land around the high-pressure port.

As one of related art that can prevent seizure of slide contact surfaces of a valve plate and a cylinder block, an axial plunger hydraulic pump or motor has been proposed (see, for example, JP51-B-14282). The axial plunger hydraulic pump or motor is configured as will be described hereinafter. A seal land extends along substantially a half part of a high-pressure port of a valve plate, said half part being on a side where a port, to which cylinder ports are to be connected, changes from a low-pressure port to the high-pressure port during operation of the pump or motor, and is located on a side inner than pads arranged on an outer circumference of the valve plate. In a seal surface of an outer portion of the seal land, said seal surface facing an end surface of the cylinder block, bottomed concavities are arranged. Hydraulic oil leaked from the high-pressure port is allowed to fill the bottomed concavities such that the effective component of press-back force, which is produced by the hydraulic oil between the seal surface of the outer portion of the seal land and the end surface of the cylinder block, can be increased.

In the above-mentioned axial plunger pump or motor of the related art, a contrivance has been made to broaden the clearance between the seal land of the valve plate on the side of the high-pressure port and the seal land by increasing the effective component of the press-back force with the hydraulic oil in the bottomed concavities arranged in the outer part of the seal land of the valve plate. However, pads are arranged over the entire periphery of an outer side of a seal land on the valve plate, and therefore, the slide contact area between the valve plate and the cylinder block increases as much as the pads. Therefore, the friction force that the cylinder block receives from the slide contact surface of the valve plate during rotation increases, leading to a concern that a torque loss may increase in association with rotation of the cylinder block.

With such actual circumstances of the related art in view, the present invention has as objects thereof the provision of hydraulic rotating equipment capable of reducing a torque loss that occurs in association with rotation of a cylinder block and also a working machine provided with the hydraulic rotating equipment.

SUMMARY OF THE INVENTION

To achieve the above-described objects, the present invention provides, in an aspect thereof, hydraulic rotating equipment provided with a rotating shaft, a cylinder block including a plurality of cylinders formed at intervals in a circumferential direction of the rotating shaft, said cylinder block being rotatable in an interlocked manner with the rotating shaft, a like plurality of pistons accommodated in the plurality of cylinders, respectively, of the cylinder block, said pistons being reciprocable in association with rotation of the cylinder block, and a valve plate maintained in slide contact with a rear end surface of the cylinder block, said rear end surface being an end surface on sides opposite to open sides of the plurality of cylinders out of opposite end surfaces of the cylinder block, wherein the valve plate comprises a low-pressure port communicable with the plurality of cylinders to supply or drain low-pressure side hydraulic oil, a high-pressure port formed in an arcuate shape over a predetermined angle along the circumferential direction of the rotating shaft and communicable with the plurality of cylinders to supply or drain high-pressure side hydraulic oil, a seal land maintained in slide contact with the rear end surface to seal hydraulic oil from the low-pressure port or high-pressure port, and a sliding contact member arranged on a periphery of the seal land in a range of the predetermined angle along the circumferential direction of the rotating shaft and maintained in slide contact with the rear end surface.

According to the present invention configured as described above, in consideration of a deviation in the thickness distribution of an oil film to be formed between the valve plate and the cylinder block during rotation of the cylinder block, the sliding contact member maintained in slide contact with the cylinder block is arranged on the periphery of the seal land in the range of the predetermined angle where the sliding contact pressure tends to become high. Owing to this configuration, the slide contact surfaces of the valve plate and cylinder block can be appropriately protected by the sliding contact member while decreasing the slide contact area between the valve plate and the cylinder block. It is, therefore, possible to sufficiently suppress seizure that occurs on the slide contact surfaces of the valve plate and cylinder block. As appreciated from the foregoing, the present invention does not require to arrange the sliding contact member over the entirety of the outer periphery of the end surface of the valve plate, said end surface being maintained in slide contact with the cylinder block, so that the torque loss associated with rotation of the cylinder block can be reduced.

The sliding contact member may preferably comprise a pad arranged deviating to a downstream side relative to a direction of rotation of the rotating shaft in the range of the predetermined angle along the circumferential direction of the rotating shaft.

According to the present invention configured as described above, the pad is arranged deviating to a part where, because the dynamic pressure of an oil film between the valve plate and the cylinder block increases as the rotational speed of the cylinder block increases, a wedge film tends to be formed due to the dynamic pressure, in other words, to a part where in the periphery of the seal land of the valve plate on the side of the high-pressure port, the sliding contact angle increases in association with the formation of a wedge film. It is, therefore, possible to cope with variations in the sliding contact pressure between the valve plate and the cylinder block in association with a rise in the rotational speed of the cylinder block even if the use amount of the pad is decreased.

The sliding contact member may preferably comprise a pad arranged on an outer side relative to the high-pressure port in a radial direction of the rotating shaft. When configured as described above, the circumferential speed of the cylinder block facing the valve plate becomes faster toward an outer side in the radial direction of the rotating shaft, leading to an increase in the reaction force by an oil film between the outer peripheral portion of the seal land of the valve plate on the side of the high-pressure port and the cylinder block. Owing to the arrangement of the pad of the valve plate on the outer side relative to the high-pressure port in the radial direction of the rotating shaft, it is possible to effectively protect, with the pad, parts where in the slide contact surfaces of the valve plate and the cylinder block, the sliding contact pressure is higher than other parts.

The sliding contact member may preferably comprise a pad arranged on an inner side relative to the high-pressure port in a radial direction of the rotating shaft. When configured as described above, the reaction force by an oil film between the seal land of the valve plate on the side of the rotating shaft and a part of the slide contact surface of the cylinder block on the side of the rotating shaft increases when the curvatures of the slide contact surfaces of the valve plate and cylinder block are different from each other. Owing to the arrangement of the pad of the valve plate on the inner side relative to the high-pressure port in the radial direction of the rotating shaft, it is possible to sufficiently protect, with the pad, parts where in the slide contact surfaces of the valve plate and the cylinder block, the sliding contact pressure is higher for the difference in curvature.

The sliding contact member may preferably comprise plural pads arranged on inner side and outer side, respectively, relative to the high-pressure port in a radial direction of the rotating shaft. When configured as described above, the individual pads are arranged with a proper balance in a radial direction of the rotating shaft in consideration of a sliding contact pressure that is to act on the slide contact surfaces of the valve plate and cylinder block. It is, therefore, possible to effectively reduce the effect of reaction force by an oil film between the seal land of the valve plate and the cylinder block.

Preferably, the sliding contact member may comprise plural pads arranged at intervals along the circumferential direction of the rotating shaft, and groove portions may be formed as flow passages for hydraulic oil between the individual pads. When configured as described above, the hydraulic oil leaked out of the low-pressure port or high-pressure port of the valve plate is allowed to flow from the groove portions between the individual pads to an outer side of the valve plate. It is, therefore, possible to prevent hydraulic oil, which has been heated up by friction between the valve plate and the cylinder block, from staying between the seal land of the valve plate and the individual pads. Owing to this, the lubricating performance of the hydraulic oil between the valve plate and the cylinder block can be maintained.

The high-pressure port may preferably include notches formed at opposite ends thereof, respectively, along the circumferential direction of the rotating shaft. When configured as described above, upon changing of a port, to which each cylinder of the cylinder block under rotation is to be connected, from the low-pressure port to the high-pressure port or from the high-pressure port to the low-pressure port of the valve plate, any sudden pressure change in hydraulic oil flowing between the high-pressure port of the valve plate and the cylinder in the cylinder block can be reduced by the notches. It is, therefore, possible to suppress the occurrence of cavitations in a flow passage for the hydraulic oil.

The present invention also provides, in another aspect thereof, a working machine provided with the hydraulic rotating equipment according to the present invention. When configured as described above, it is possible to sufficiently meet the output characteristics of hydraulic rotating equipment as required for high-load work such as digging or the like to be performed generally by the hydraulic rotating equipment. Accordingly, the hydraulic rotating equipment in the working machine can be provided with improved durability, and further, an excellent energy efficiency can be obtained.

According to the hydraulic rotating equipment of the present invention and the working machine of the present invention provided with the hydraulic rotating equipment, the torque loss associated with rotation of the cylinder block can be reduced. Problems, configurations and effects other than those mentioned above will become apparent from the description of the embodiments to be described hereinafter.

DETAILED DESCRIPTION OF PREFERRED EMBODIMENTS

Based on the drawings, a description will hereinafter be made of modes for carrying out the hydraulic rotating equipment according to the present invention.

First Embodiment

Figure 1:
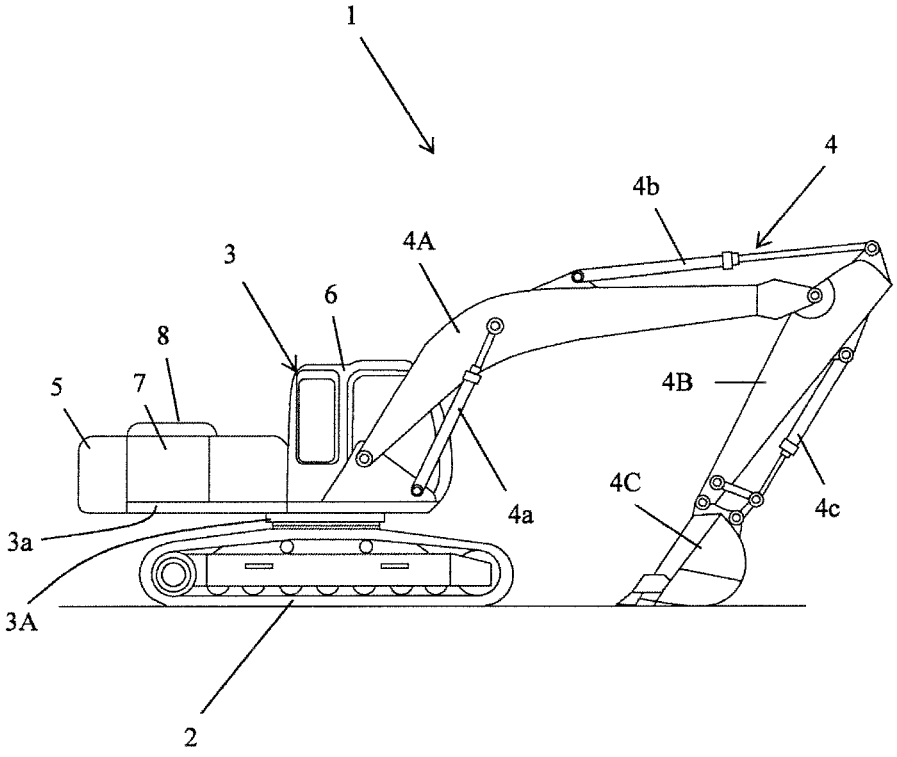
FIG. 1 is a view illustrating the configurations of a hydraulic excavator taken as an example of a working machine in which a first embodiment of the hydraulic rotating equipment according to the present invention can be arranged.

FIG. 1 is a view illustrating the configurations of a hydraulic excavator taken as an example of a working machine in which a first embodiment of the hydraulic rotating equipment according to the present invention can be arranged.

The first embodiment of the hydraulic rotating equipment according to the present invention can be arranged in a working machine, for example, a crawler hydraulic excavator 1 that is shown in FIG. 1 and performs work such as digging. This hydraulic excavator 1 is constructed of a travel base 2, a revolving upperstructure 3 arranged on an upper side of the travel base 2 and having a revolving frame 3*a*, a swing mechanism 3A interposed between these travel base 2 and revolving upperstructure 3 for swinging the revolving upperstructure 3, and a front working mechanism 4 attached to a front part of the revolving upperstructure 3 such that the front working mechanism is pivotal in an up-to-down direction.

The front working mechanism 4 includes a boom 4A, boom cylinders 4*a*, an arm 4B, an arm cylinder 4*b*, a bucket 4C, and a bucket cylinder 4*c*. The boom 4A is pivotally attached at a basal end thereof to the revolving frame 3*a* and is pivotal in the up-and-down direction. The boom cylinders 4*a* connect the revolving upperstructure 3 and the boom 4A together, and extend and retract to pivot the boom 4A. The arm 4B is pivotally attached to a free end of the boom 4A. The arm cylinder 4*b* is arranged on an upper side of the boom 4A, connects the boom 4A and the arm 4B together, and extends and retracts to pivot the arm 4B. The bucket 4C is pivotally attached to a free end of the arm 4B. The bucket cylinder 4*c* connects the arm 4B and the bucket 4C together, and extends and retracts to pivot the bucket 4C.

The above-mentioned revolving upperstructure 3 is provided with a counterweight 5, a cab 6, an engine compartment 7, and a body cover 8. The counterweight 5 is disposed, for example, on a rear part of a body, and maintains balance of the body. The cab 6 is disposed on a front left part of the body, and houses an operator who operates the front working mechanism 4. The engine compartment 7 is disposed between these counterweight 5 and cab 6. The body cover 8 is disposed on an upper part of the engine compartment 7, and forms the exterior of an upper part of the body. It is to be noted that, although not shown in the figure, an engine as a drive source of operations of the body, control valves for controlling the flow rates and directions of hydraulic oil to be fed to the respective cylinders 4*a*-4*c*, a hydraulic oil tank for storing hydraulic oil therein, and the like are disposed in the engine compartment 7.

Figure 2:
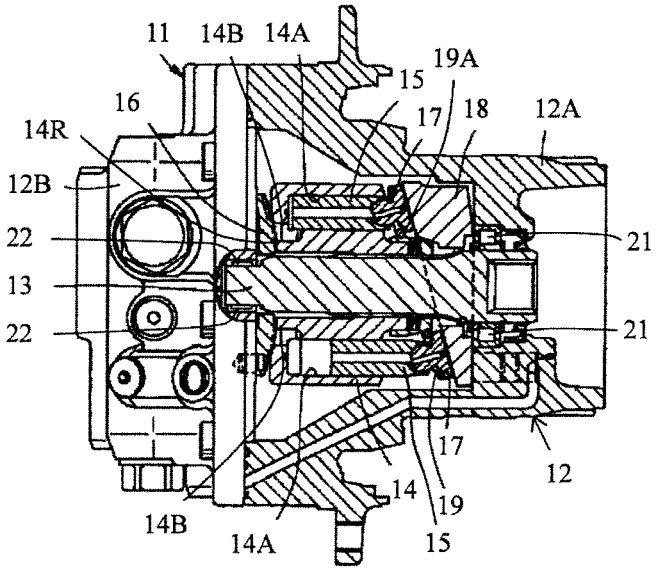
FIG. 2 is a view showing the configurations of swash-plate hydraulic rotating equipment applied as the first embodiment of the hydraulic rotating equipment according to the present invention.

FIG. 2 is a view showing the configurations of swash-plate hydraulic rotating equipment applied as the first embodiment of the hydraulic rotating equipment according to the present invention.

As shown by way of example in FIG. 2, the first embodiment of the present invention is comprised of swash-plate hydraulic rotating equipment 11 that functions as a hydraulic pump or hydraulic motor. This swash-plate hydraulic rotating equipment 11 is provided with a casing 12, a rotating shaft 13, a cylinder block 14, and a plurality of pistons 15. The casing 12 forms an outer shell. The rotating shaft 13 is disposed rotatably about an axis thereof in a central part of the casing 12. The cylinder block 14 includes a plurality of cylinders 14A formed at intervals in a circumferential direction of the rotating shaft 13, and rotates in an interlocked manner with the rotating shaft 13. The plurality of pistons 15 are accommodated in the plurality of cylinders 14A, respectively, of the cylinder block 14, and reciprocate in association with rotation of the cylinder block 14.

The swash-plate hydraulic rotating equipment 11 is also provided with a valve plate 16, a plurality of shoes 17, a swash plate 18, and a retainer 19. The valve plate 16 is maintained in slide contact with a rear end surface 14R of the cylinder block 14. Of opposite end faces of the cylinder block 14, the rear end surface 14R is an end surface on a side opposite to open ends of the plurality of cylinders 14A. The plurality of shoes 17 are rockably held on end portions of the individual pistons 15, respectively, on a side of the open ends of the plurality of cylinders 14A out of the opposite end surfaces of the cylinder block 14, and rotate together with the cylinder block 14. The swash plate 18 is tiltably disposed on a side of a below-mentioned front casing 12A in the casing 12, and the respective shoes 17 are maintained in slide contact with the swash plate 18. The retainer 19 holds via a retainer guide 19A the respective shoes 17 in a state that the shoes 17 are pressed toward the swash plate 18 under pressing force of the cylinder block 14, and stabilizes the state of sliding contact of the respective shoes 17 with the swash plate 18.

The casing 12 is comprised of the above-mentioned front casing 12A and a rear casing 12B. The front casing 12A is formed in a cylindrical shape, accommodates therein members such as the rotating shaft 13 and cylinder block 14, and is bottomed. The rear casing 12B closes up an opening of the front casing 12A. The rotating shaft 13 is supported rotatably about the axis thereof via bearings 21,22 and the like between the front casing 12A and the rear casing 12B. One end of the rotating shaft 13, said one end being on a side of the front casing 12A out of opposite ends of the rotating shaft 13, is connected to an output shaft of the engine in the engine compartment 7, so that the rotating shaft 13 rotates by drive force of the engine.

The cylinder block 14 is disposed with the end surface on the side of the open ends of the plurality of cylinders 14A, out of the opposite end surfaces thereof, facing the swash plate 18, and is splined on a side of an outer circumference of the rotating shaft 13. By rotation of the cylinder block 14 integrally with the rotating shaft 13, the cylinder block 14 slides on the valve plate 16 while maintaining the respective shoes 17 in slide contact with the swash plate 18. The respective cylinders 14A of the cylinder block 14 are spaced at certain constant intervals therebetween about the axis of the cylinder block 14 with the rotating shaft 13 serving as a center, and are disposed in parallel with the direction of the axis of the cylinder block 14, in other words, the direction of the axis of the rotating shaft 13. Through the end of the cylinder block 14 on the side of the rear casing 12B, cylinder ports 14B are formed, as flow passages for hydraulic oil, extending from the surface toward inner ends of the respective cylinders 14A.

Figure 3:
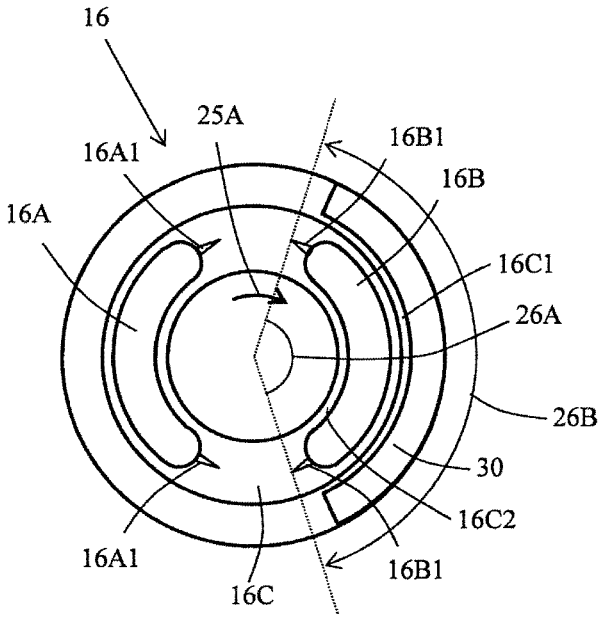
FIG. 3 is a front view of a valve plate shown in FIG. 2 as viewed from a cylinder block.

FIG. 3 is a front view of the valve plate shown in FIG. 2 as viewed from the cylinder block.

As shown in FIG. 3, the valve plate 16 includes a low-pressure port 16A, a high-pressure port 16B, and a seal land 16C. The low-pressure port 16A is formed in an arcuate shape over a predetermined angle 24A (see FIG. 13) along the circumferential direction of the rotating shaft 13 (see FIG. 2), and is communicable with the plurality of cylinders 14A via the cylinder ports 14B to supply or drain low-pressure side hydraulic oil. The high-pressure port 16B is formed in an arcuate shape over a predetermined angle 26A along the circumferential direction of the rotating shaft 13, and is communicable with the plurality of cylinders 14A via the cylinder ports 14B to supply or drain high-pressure side hydraulic oil. The seal land 16C is maintained in slide contact with the rear end surface 14R of the cylinder block 14, and seals hydraulic oil from the low-pressure port 16A or high pressure port 16B.

This seal land 16C is formed in an annular shape extending from the surface of the valve plate 16 toward the cylinder block 14 such that the hydraulic oil, which flows between the valve plate 16 and the cylinder block 14, does not leak to the outside, and an oil film of hydraulic oil is formed between the valve plate 16 and the cylinder block 14. The low-pressure port 16A of the valve plate 16 includes notches 16A1 formed at opposite ends thereof along the circumferential direction of the rotating shaft 13, while the high-pressure port 16B includes notches 16B1 at opposite ends thereof along the circumferential direction of the rotating shaft 13.

When the swash-plate hydraulic rotating equipment 11 (see FIG. 2) functions as a hydraulic pump, the cylinder block 14, therefore, rotates together with the rotating shaft 13 in a forward direction (clockwise as shown in FIG. 3) 25A so that the respective pistons 15 reciprocate. Therefore, the hydraulic oil supplied from the hydraulic oil tank to the valve plate 16 flows from the low-pressure port 16A and through the cylinder ports 14B into the cylinders 14A, is pressurized by the pistons 15 and is delivered from the high-pressure port 16B of the valve plate 16, and subsequently, is supplied to the respective cylinders 4*a*-4*c* of the front working mechanism 4 (see FIG. 1) via control valves. As a result, the respective cylinders 4*a*-4*c* extend or retract by the hydraulic pressure of the hydraulic oil so supplied, and the front working mechanism 4 can be operated to perform work such as digging.

When the swash-plate hydraulic working machine 11 functions as a hydraulic motor, on the other hand, the pistons 15 are pressed toward the side of the swash plate 18 under the hydraulic pressure of the hydraulic oil by allowing high-pressure hydraulic oil to flow from the high-pressure port 16B of the valve plate 16 into the cylinders 14 via the cylinder ports 14B. Therefore, the rotating shaft 13 rotates together with the cylinder block 14 in a reverse direction 25B (see FIG. 13) that is opposite to the forward direction 25A. As a result, rotational motion of the rotating shaft 13 can be taken out from the hydraulic pressure of the hydraulic oil.

Based on FIGS. 4 to 6, the valve plate 16 in the first embodiment of the present invention will now be described in detail in comparison with the valve plate in the related art to facilitate the understanding of the configurations of the valve plate 16 in the first embodiment of the present invention. It is to be noted that with respect to the valve plate in the related art, the same or corresponding parts as in the first embodiment of the present invention are identified by like reference signs in the following description.

Figure 4:
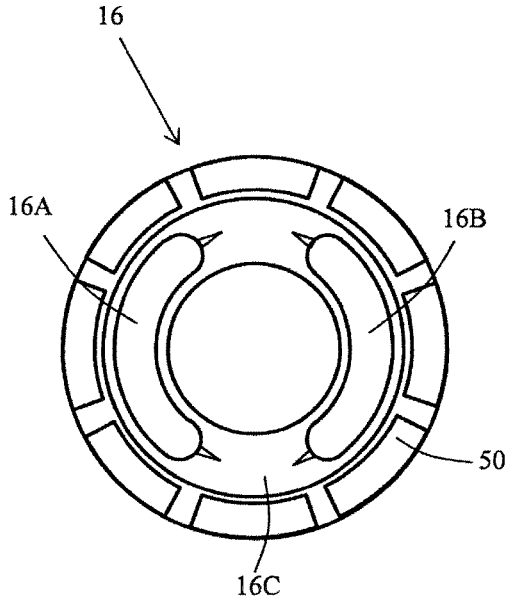
FIG. 4 is a front view of a valve plate in hydraulic rotating equipment of related art as viewed from a cylinder block.
Figure 5:
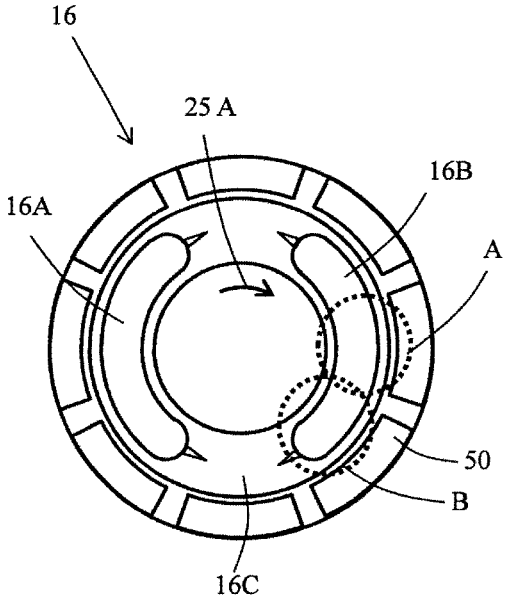
FIG. 5 is a view illustrating a state of sliding contact of the valve plate in the hydraulic rotating equipment of the related art with the cylinder block.
Figure 6:
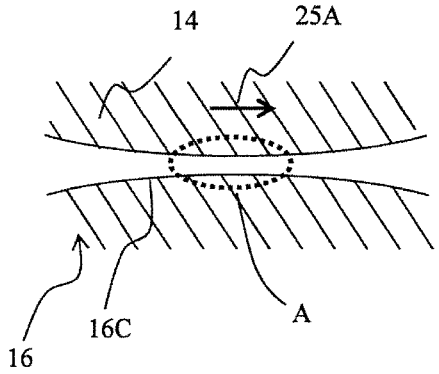
FIG. 6 is a view depicting on an enlarged scale a state of sliding contact in a vicinity A in FIG. 5 when the rotational speed of the cylinder block in the hydraulic rotating equipment of the related art is low.

FIG. 4 is a front view of a valve plate in hydraulic rotating equipment of related art as viewed from a cylinder block, FIG. 5 is a view illustrating a state of sliding contact of the valve plate in the hydraulic rotating equipment of the related art with the cylinder block, and FIG. 6 is a view depicting on an enlarged scale a state of sliding contact in the vicinity A in FIG. 5 when the rotational speed of the cylinder block in the hydraulic rotating equipment of the related art is low.

As shown in FIGS. 4 and 5, a valve plate 16 in the related art is common to the valve plate 16 in the first embodiment of the present invention in that the former valve plate 16 is provided with a low-pressure port 16A, a high-pressure port 16B and a seal land 16C. However, the valve plate 16 in the related art is provided with pads 50 disposed over the entire circumference of a surface on an outer side of the seal land 16C.

As the rotational speed of the cylinder block 14 increases, the dynamic pressure of an oil film between the valve plate 16 and the cylinder block 14 generally rises, thereby tending to form a wedge film due to this dynamic pressure. When the rotational speed of the cylinder block 14 is low, a wedge film is hence hardly formed between the valve plate 16 and the cylinder block 14 so that in an oil film formed between the seal land 16C of the valve plate 16 and the cylinder block 14, the oil film in a vicinity A of the center of the high-pressure port 16B becomes thinnest as depicted in FIG. 6. Therefore, the sliding contact pressure between the valve plate 16 and the cylinder block 14 in this vicinity A of the center tends to become higher compared with those at other parts.

In the first embodiment of the present invention, the valve plate 16, therefore, includes a sliding contact member, which as shown in FIG. 3, is arranged in a range 26B of a predetermined angle 26A along the circumferential direction of the rotating shaft 13 out of the periphery of the seal land 16C and is maintained in slide contact with the rear end surface 14R of the cylinder block 14. This sliding contact member is comprised of a pad 30 arranged, for example, on an outer side relative to the high-pressure port 16B in the radial direction of the rotating shaft 13. It is to be noted that the above-mentioned range 26B of the predetermined angle 26A is set in the region of a rotary angle of the rotating shaft 13, for example, from the notch 16B1 at the one end of the high-pressure port 16B of the valve plate 16 to the notch 16B1 at the other end and that the pad 30 is arranged over the entire surface on the outer side of the seal land 16C in this region.

According to the first embodiment of the present invention configured as described above, the arrangement of the pad 30 only in the range 26B, in which the sliding contact pressure between the valve plate 16 and the cylinder block 14 tends to become high, can appropriately protect the slide contact surfaces of the valve plate 16 and cylinder block 14 by the pad 30 and can hence sufficiently suppress the occurrence of seizure on the slide contact surfaces of the valve plate 16 and cylinder block 14, while reducing the area of sliding contact between the valve plate 16 and the cylinder block 14, even when the pad 50 is not arranged over the entirety of the outer circumference of the end surface of the valve plate 16, said outer circumference being maintained in slide contact with the cylinder block 14, as in the related art. As a consequence, the torque loss associated with rotation of the cylinder block 14 can be decreased, thereby providing the swash-plate hydraulic rotating equipment 11 with high reliability. In particular, this swash-plate hydraulic rotating equipment 11 is suited for the hydraulic excavator 1 useful in high-load work such as digging, and can provide the hydraulic excavator 1 with improved work performance.

In the first embodiment of the present invention, the reaction force by an oil film between an outer circumferential part 16C1 of the seal land 16C of the valve plate 16 on the side of the high-pressure port 16B and the cylinder block 14 becomes greater than the reaction force by an oil film between an inner circumferential part 16C2 of the seal land 16 on the side of the high-pressure port 16B, because the circumferential speed of the cylinder block 14 relative to the valve plate 16 becomes faster toward an outer side in the radial direction of the rotating shaft 13.

On the other hand, the pad 30 on the valve plate 16 is arranged on the outer side relative to the high-pressure port 16B in the radial direction of the rotating shaft 13, so that the effect of the reaction force by the oil film between the outer circumferential part 16C1 of the seal land 16C on the side of the high-pressure port 16B and the cylinder block 14 can be reduced by the pad 30. As a consequence, the slide contact surfaces of the valve plate 16 and cylinder block 14 can be effectively protected by the pad 30, so that the valve plate 16 and cylinder block 14 can be provided with longer service life.

In the first embodiment of the present invention, the notches 16B1 are formed at the opposite ends of the high-pressure port 16B of the valve plate 16 along the circumferential direction of the rotating shaft 13. Upon changing of a port, to which the cylinder port 14B of each cylinder 14A is to be connected by rotation of the cylinder block 14 in the forward direction 25A in an interlocked manner with the rotating shaft 13, from the low-pressure port 16A to the high-pressure port 16B or from the high-pressure port 16B to the low-pressure port 16A of the valve plate 16, any sudden pressure change in hydraulic oil flowing between the high-pressure port 16B and the cylinder 14A can be reduced by the notches 16B1. It is, therefore, possible to suppress the occurrence of cavitations in a flow passage for the hydraulic oil, and to prevent damage to the valve plate 16 or cylinder block 14 or the occurrence of vibration and noise during rotation of the cylinder block 14.

Second Embodiment

Figure 7:
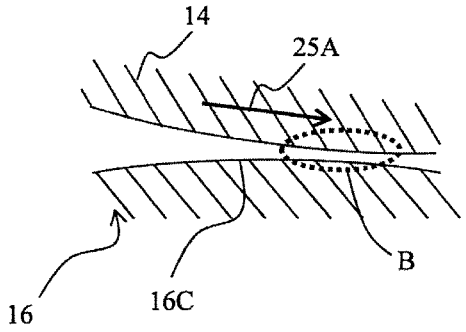
FIG. 7 is a view depicting on an enlarged scale a state of sliding contact in a vicinity B in FIG. 5 when the rotational speed of the cylinder block in the hydraulic rotating equipment of the related art has increased from the low speed.
Figure 8:
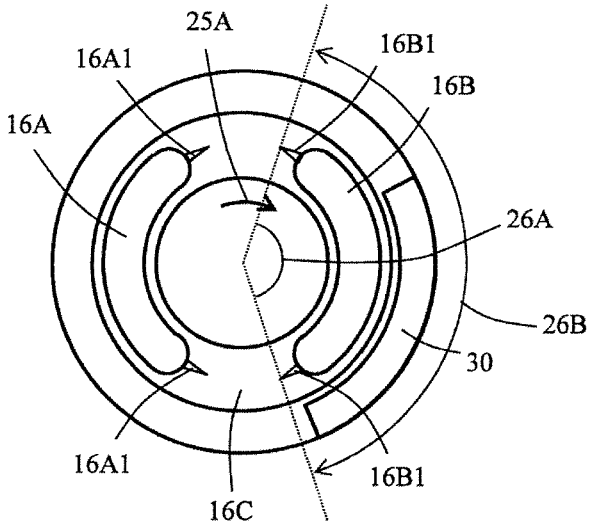
FIG. 8 is a view illustrating the configurations of essential parts of a second embodiment of the present invention, and is a front view of a valve plate as viewed from a cylinder block.

FIG. 7 is a view depicting on an enlarged scale a state of sliding contact in a vicinity B in FIG. 5 when the rotational speed of the cylinder block in the hydraulic rotating equipment of the related art has increased from the low speed, and FIG. 8 is a view illustrating the configurations of essential parts of a second embodiment of the present invention, and is a front view of a valve plate as viewed from a cylinder block.

As depicted in FIG. 7, when the rotational speed of the cylinder block 14 increases from a low speed, the dynamic pressure of an oil film between the valve plate 16 and the cylinder block 14 rises and a wedge film tends to be formed between the valve plate 16 and the cylinder block 14. In an oil film formed between the seal land 16C of the valve plate 16 on the side of the high-pressure port 16B and the cylinder block 14, the oil film in a downstream vicinity B relative to the direction of rotation (forward direction) 25A of the cylinder block 14 becomes thinnest. Therefore, the sliding contact pressure between the valve plate 16 and the cylinder block 14 in this downstream vicinity B tends to become higher compared with those at other parts.

The pad 30 in the first embodiment of the present invention is arranged over the entirety of the surface of the valve plate 16 on the outer side of the seal land 16C in the above-mentioned range 26B of the predetermined angle 26A, while a pad 30 in the second embodiment of the present invention is arranged deviating to a downstream side relative to the direction of rotation (forward direction) 25A of the rotating shaft 13 in the above-mentioned range 26B of the predetermined angle 26A along the circumferential direction of the rotating shaft 13 as illustrated, for example, in FIG. 8. The remaining configurations are similar to those of the above-mentioned first embodiment, and the same or corresponding parts as in the first embodiment are identified by like reference signs.

According to the second embodiment of the present invention configured as described above, similar advantageous effects as the above-mentioned first embodiment are obtained. In addition, the pad 30 is arranged deviating to the part where, in the slide contact surfaces of the seal land 16C of the valve plate 16 on the side of the high-pressure port 16B and cylinder block 14, the sliding contact pressure between the valve plate 16 and the cylinder block 14 tends to become relatively high. It is, therefore, possible to cope with variations in the sliding contact pressure between the valve plate 16 and the cylinder block 14 in association with a rise in the rotational speed of the cylinder block 14 even if the use amount of the pad 30 is smaller than that of the pad 30 in the first embodiment. As a consequence, a high volumetric efficiency can be assured even when the work by the hydraulic excavator 1 is under use conditions of high load or the like.

Third Embodiment

Figure 9:
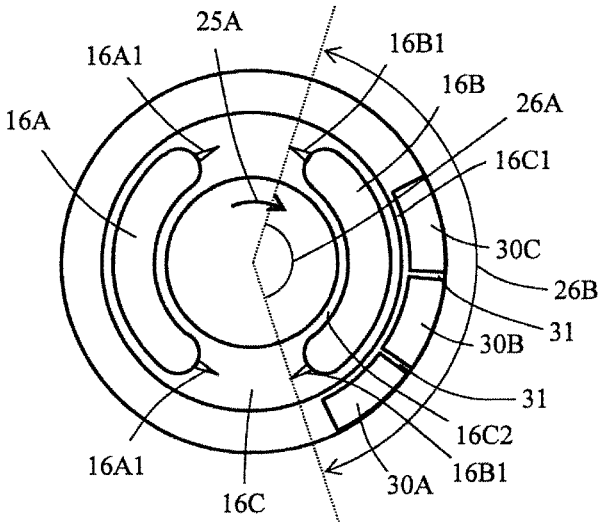
FIG. 9 is a view illustrating the configurations of essential parts of a third embodiment of the present invention, and is a front view of a valve plate as viewed from a cylinder block.

FIG. 9 is a view illustrating the configurations of essential parts of a third embodiment of the present invention, and is a front view of a valve plate as viewed from a cylinder block.

The third embodiment of the present invention is different from the above-mentioned second embodiment in that as illustrated, for example, in FIG. 9, a sliding contact member in the third embodiment is comprised of three pads 30A-30C arranged at intervals along the circumferential direction of the rotating shaft 13 and groove portions 31 are formed as flow passages for hydraulic oil between these individual pads 30A-30C, while as illustrated in FIG. 8, the sliding contact member in the second embodiment is comprised of the pad 30 arranged deviating to the downstream side relative to the direction of rotation (forward direction) 25A of the rotating shaft 13 in the above-mentioned range 26B of the predetermined angle 26A along the circumferential direction of the rotating member 13. It is to be noted that the number of the pads 30A-30C is not limited to three and may be 2 or 4 or more. The remaining configurations are similar to those of the above-mentioned second embodiment, and the same or corresponding parts as in the second embodiment are identified by like reference signs.

According to the third embodiment of the present invention configured as described above, similar advantageous effects as the above-mentioned second embodiment are obtained. In addition, hydraulic oil leaked out of the low-pressure port 16A or high-pressure port 16B of the valve plate 16 is allowed to flow from the groove portions 31 between the individual pads 30A-30C to the outside of the valve plate 16. As a result of rotation of the cylinder block 14 together with the rotating shaft 13 and its sliding on the valve plate 16, heated hydraulic oil can be prevented from staying at a part 16C1 between the seal land 16C of the valve plate 16 and the individual pads 30A-30C. As a consequence, the lubrication performance of hydraulic oil between the valve plate 16 and the cylinder block 14 can be retained so that the sliding motion of the cylinder block 14 on the valve plate 16 can be performed well.

Fourth Embodiment

Figure 10:
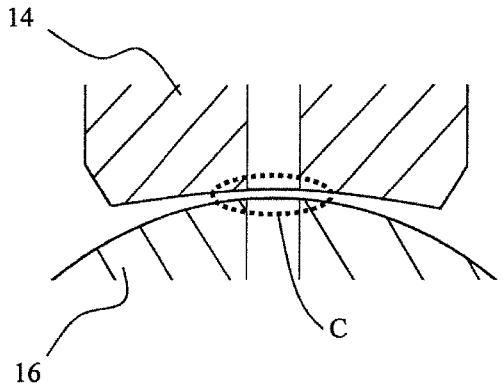
FIG. 10 is a view illustrating the configurations of essential parts of a fourth embodiment of the present invention, and is a schematic cross-sectional view depicting on an enlarged scale slide contact surfaces of a valve plate and cylinder block on a side of a rotating shaft.
Figure 11:
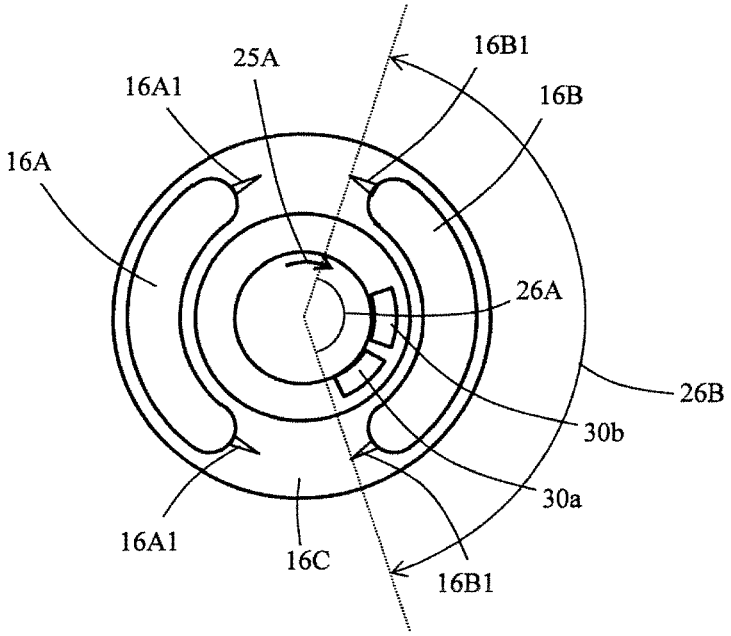
FIG. 11 is a view illustrating the configurations of essential parts of the fourth embodiment of the present invention, and is a front view of the valve plate as viewed from the cylinder block.

FIG. 10 is a view illustrating the configurations of essential parts of a fourth embodiment of the present invention, and is a schematic cross-sectional view depicting on an enlarged scale slide contact surfaces of a valve plate and cylinder block on a side of a rotating shaft, and FIG. 11 is a view illustrating the configurations of essential parts of the fourth embodiment of the present invention, and is a front view of the valve plate as viewed from the cylinder block.

When the curvature of a slide contact surface of a valve plate 16 is greater than the curvature of a slide contact surface of a cylinder block 14 as illustrated in FIG. 10, a seal land 16C of the valve plate 16 on the side of the rotating shaft 13 and the slide contact surface of the cylinder block 14 on the side of the rotating shaft 13 come close to each other, and therefore, large reaction force is produced by an oil film formed in an area C between the seal land 16C of the valve plate 16 on the side of the rotating shaft 13 and the slide contact surface of the cylinder block 14 on the side of the rotating shaft 13.

While the individual pads 30A-30C in the third embodiment of the present invention are arranged on the outer side relative to the high-pressure port 16B in the radial direction of the rotating shaft 13 as illustrated in FIG. 9, pads 30*a*,30*b* in the fourth embodiment are arranged on an inner side relative to the high-pressure port 16B in the radial direction of the rotating shaft 13 as illustrated, for example, in FIG. 11. The size of the individual pads 30*a*,30*b* in the fourth embodiment of the present invention is set smaller than the size of the individual pads 30A-30C in the above-mentioned third embodiment. It is to be noted that the number of the pads 30*a*, 30*b* are not limited to two and a single pad may be arranged without forming such a groove portion as the groove portions 31 in FIG. 9 or three or more pads may be arrange as in the third embodiment of the present invention. The remaining configurations are similar to those of the above-mentioned third embodiment, and the same or corresponding parts as in the third embodiment are identified by like reference signs.

According to the fourth embodiment of the present invention configured as described above, the individual pads 30*a*, 30*b* of the valve plate 16 are arranged on the inner side relative to the high-pressure port 16B in the radial direction of the rotating shaft 13 unlike the above-mentioned third embodiment, so that in the slide contact surfaces of the valve plate 16 and cylinder block 14, the parts where the sliding contact pressure has become high due to the difference in curvature can be sufficiently protected by the pads 30*a*, 30*b*. The individual pads 30*a*, 30*b* can also be applied to the valve plate 16 having the different curvature from the slide contact surface of the cylinder block 14 as described above, and therefore, are excellent in general versatility. Further, these pads 30*a*,30*b* are close to the rotating shaft 13, and can have a size smaller than the size of the individual pads 30A-30C in the third embodiment. It is, therefore, possible to decrease the slide contact area between the valve plate 16 and the cylinder block 14 and to improve the volumetric efficiency still further.

Fifth Embodiment

Figure 12:
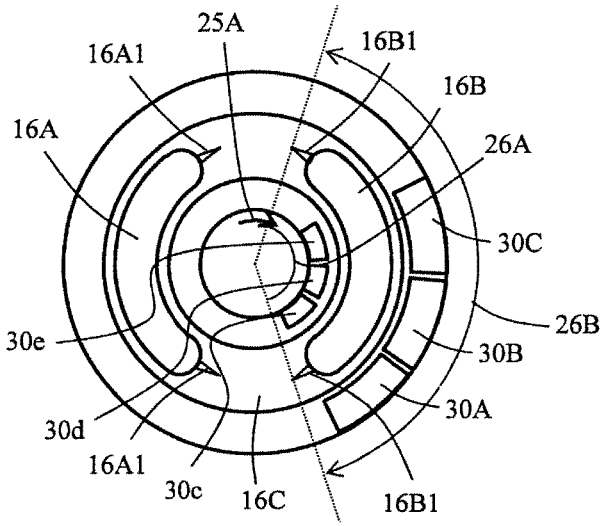
FIG. 12 is a view illustrating the configurations of essential parts of a fifth embodiment of the present invention, and is a front view of a valve plate as viewed from a cylinder block.

FIG. 12 is a view illustrating the configurations of essential parts of a fifth embodiment of the present invention, and is a front view of a valve plate as viewed from a cylinder block.

A sliding contact member in the fifth embodiment of the present invention is comprised of pads 30A-30C and 30*c*-30*e*, which as illustrated, for example, in FIG. 12, are arranged on an inner side and outer side, respectively, relative to the high-pressure port 16B in the radial direction of the rotating shaft 13. Of these pads 30A-30C and 30*c*-30*e*, the pads 30A-30C are the same as the pads 30A-30C in the above-mentioned third embodiment, and the pads 30*a*-30*c* correspond to the pads 30*a*, 30*b* in the above-mentioned fourth embodiment. The remaining configurations are similar to those of the above-mentioned third and fourth embodiments, and the same or corresponding parts as in the third and fourth embodiment are identified by like reference signs.

According to the fifth embodiment of the present invention configured as described above, similar advantageous effects as the above-mentioned third and fourth embodiments are obtained. In addition, the individual pads 30A-30C and 30*c*-30*e* are arranged with a proper balance in the radial direction of the rotating shaft 13, so that the effect of reaction force by an oil film between a seal land 16C of the valve plate 16 and the cylinder block 14 can be effectively reduced to realize providing the cylinder block 14 with stable sliding performance. As a consequence, the valve plate 16 and cylinder block 14 can be provided with improved durability.

Sixth Embodiment

Figure 13:
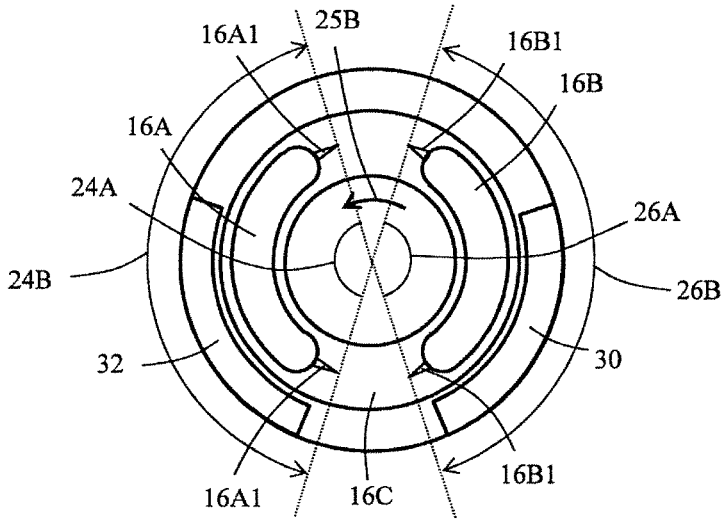
FIG. 13 is a view illustrating the configurations of essential parts of a sixth embodiment of the present invention, and is a front view of a valve plate as viewed from a cylinder block.

FIG. 13 is a view illustrating the configurations of essential parts of a sixth embodiment of the present invention, and is a front view of a valve plate as viewed from a cylinder block.

When the swash-plate hydraulic rotating equipment 11 functions as a hydraulic motor, the cylinder block 14 rotates in the reverse direction 25B opposite to the forward direction 25A. The low-pressure port 16B and high-pressure port 16B of the valve plate 16, therefore, change with each other. As illustrated in FIG. 13, a sliding contact member in the sixth embodiment of the present invention is hence comprised, in addition to the pad 30 in the second embodiment, of a pad 32 that is arranged in the range 24B of the predetermined angle 24A along the circumferential direction of the rotating shaft 13 in the periphery of the seal land 16C and is maintained in slide contact with the rear end surface 14R of the cylinder block 14.

This pad 32 is arrange on an outer side relative to the low-pressure port (the high-pressure port during rotation in the reverse direction 25B) 16A of the valve plate 16 in the radial direction of the rotating shaft 13, and further, is arranged deviating to a downstream side relative to the direction of rotation (reverse direction 25B) of the rotating shaft 13 in a range 24B of a predetermined angle 24A along the circumferential direction of the rotating shaft 13. In addition, the shape and size of the pad 32 are set in the same shape and size as the pad 30 in the above-mentioned second embodiment. It is to be noted that the pad 32 may be arranged on an inner side relative to the low-pressure port (the high-pressure port during rotation in the reverse direction 25B) 16A of the valve plate 16 in the radial direction of the rotating shaft 13. The remaining configurations are similar to those of the second embodiment, and the same or corresponding parts as in the second embodiment are identified by like reference signs.

According to the sixth embodiment of the present invention configured as described above, similar advantageous effects as in the above-mentioned case of functioning as a hydraulic pump can be also obtained when the swash-plate hydraulic rotating equipment 11 functions as a hydraulic motor.

Seventh Embodiment

Figure 14:
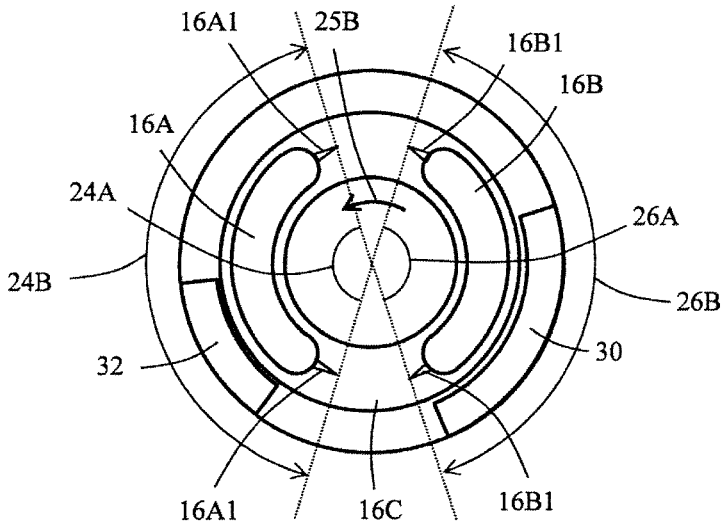
FIG. 14 is a view illustrating the configurations of essential parts of a seventh embodiment of the present invention, and is a front view of a valve plate as viewed from a cylinder block.

FIG. 14 is a view illustrating the configurations of essential parts of a seventh embodiment of the present invention, and is a front view of a valve plate as viewed from a cylinder block.

The seventh embodiment of the present invention is different from the above-mentioned sixth embodiment in that the shape and size of a pad 32 in the seventh embodiment are set beforehand corresponding to the maximum rotational speed of the rotating shaft 13 which rotates in the reverse direction 25B as illustrated, for example, in FIG. 14, while the shape and size of the pad 32 in the sixth embodiment are set in the same shape and size of the pad 30 in the second embodiment as illustrated in FIG. 13. Therefore, the shapes and sizes of a pad 30 and the pad 32 in the seventh embodiment of the present invention may be different from each other. The remaining configurations are similar to those of the sixth embodiment, and the same or corresponding parts as in the sixth embodiment are identified by like reference signs.

According to the seventh embodiment of the present invention configured as described above, similar advantageous effects as the above-mentioned sixth embodiment are obtained. In addition, even in the case that the maximum rotational speed differs depending on the direction of rotation of the rotating shaft 13, the swash-plate hydraulic rotating equipment 11 can be used according to the rotation characteristics of the rotating shaft 13, and can bring about high convenience.

It is to be noted that the foregoing embodiments have been described in detail to facilitate the understanding of the present invention and are not necessarily limited to those including all the described configurations. Further, a part or parts of the configurations of one of the embodiments can be replaced by the corresponding part or parts of the configurations of another one of the embodiments. Furthermore, a part or parts of the configurations of one of the embodiments can be added to the configurations of another one of the embodiments.

The swash-plate hydraulic rotating equipment 11 of each of the foregoing embodiments has been described based on its arrangement in the hydraulic excavator 1, but is not limited to such an application and may be mounted on a working machine such as a wheel loader.

Figure 15:
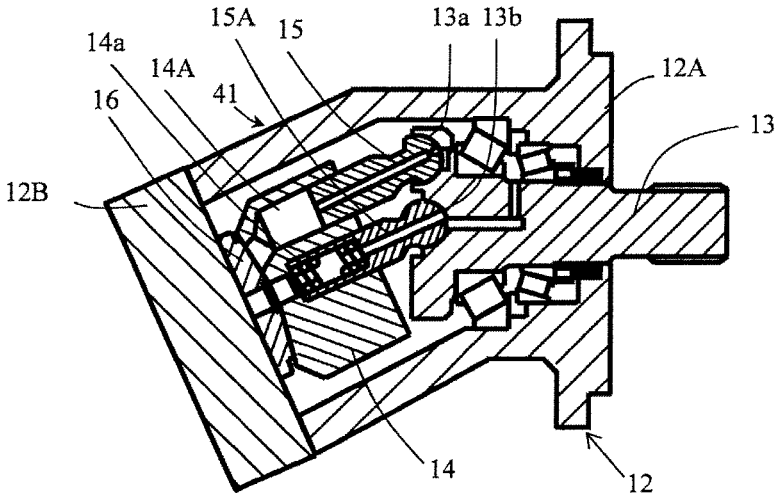
FIG. 15 is a view showing the configurations of angled-piston hydraulic rotating equipment applied as a yet further embodiment of the hydraulic rotating equipment according to the present invention.

Each of the foregoing embodiments has been described taking, as illustrative hydraulic rotating equipment, the swash-plate hydraulic rotating equipment 11 that functions as a hydraulic pump or a hydraulic motor. However, the hydraulic rotating equipment is not limited to such a case, and as shown by way of example in FIG. 15, may be comprised of angled-piston hydraulic rotating equipment 41 that is provided with a center cylinder 14*a* arranged centrally in a cylinder block 14, a center piston 15A inserted in the center cylinder 14*a*, a plurality of spherical seats 13*a* formed on one end of a rotating shaft 13, said one end being on a side of pistons 15, at intervals in a circumferential direction of the rotating shaft 13 and supporting rod ends of the respective pistons 15 resting thereon, and a central spherical seat 13*b* formed on the one end of the rotating shaft 13, said one end being on the side of the piston 15, at a central part of the rotating shaft 13, supporting the center piston 15A resting thereon and serving to perform positioning of the cylinder block 14.

The invention claimed is:

1. An hydraulic rotating equipment provided with:

a rotating shaft, a cylinder block including a plurality of cylinders formed at intervals in a circumferential direction of the rotating shaft, said cylinder block being rotatable in an interlocked manner in association with the rotating shaft, a like plurality of pistons accommodated in the plurality of cylinders, respectively, of the cylinder block, said pistons being reciprocable with rotation of the cylinder block, and a valve plate maintained in slide contact with a rear end surface of the cylinder block, said rear end surface being an end surface on sides opposite to open sides of the plurality of cylinders out of opposite end surfaces of the cylinder block, wherein the valve plate comprises:

a low-pressure port communicable with the plurality of cylinders to supply or drain low-pressure side hydraulic oil, a high-pressure port formed in an arcuate shape over a predetermined angle along the circumferential direction of the rotating shaft and communicable with the plurality of cylinders to supply or drain high-pressure side hydraulic oil, a seal land maintained in slide contact with the rear end surface to seal hydraulic oil from the low-pressure port or high-pressure port, and a sliding contact member arranged on a periphery of the seal land in a range of the predetermined angle, which is a rotary angle of the rotating shaft from one end of the high-pressure port to the other end of the high-pressure port, along the circumferential direction of the rotating shaft and maintained in slide contact with the rear end surface, wherein the sliding contact member is arranged deviating to a downstream side relative to a direction of rotation of the rotating shaft in the range of the predetermined angle along the circumferential direction of the rotating shaft and is arranged on an inner side relative to the high-pressure port in a radial direction of the rotating shaft, the rear end surface of the cylinder block and a slide contact surface of the valve plate sliding to the cylinder block are curved surfaces respectively, a curvature of the slide contact surface of the valve plate is greater than a curvature of the rear end surface of the cylinder block.

2. A working machine provided with the hydraulic rotating equipment according to claim 1.

3. The hydraulic rotating equipment according to claim 1, wherein: the sliding contact member comprises a pad arranged on an outer side relative to the high-pressure port in the radial direction of the rotating shaft.

4. A working machine provided with the hydraulic rotating equipment according to claim 3.

5. The hydraulic rotating equipment according to claim 1, wherein: the sliding contact member comprises plural pads arranged on inner side and an outer side, respectively, relative to the high-pressure port in the radial direction of the rotating shaft.

6. A working machine provided with the hydraulic rotating equipment according to claim 5.

7. The hydraulic rotating equipment according to claim 1, wherein: the sliding contact member comprises plural pads arranged at intervals along the circumferential direction of the rotating shaft, and groove portions are formed as flow passages for hydraulic oil between the individual pads.

8. A working machine provided with the hydraulic rotating equipment according to claim 7.

9. The hydraulic rotating equipment according to claim 1, wherein: the high-pressure port includes notches formed at opposite ends thereof, respectively, along the circumferential direction of the rotating shaft.

10. A working machine provided with the hydraulic rotating equipment according to claim 9.

* * * * *